US010829986B2

(12) United States Patent
McElvany et al.

(10) Patent No.: US 10,829,986 B2
(45) Date of Patent: Nov. 10, 2020

(54) HVAC SYSTEMS HAVING AIR-TIGHT ACCESS DOORS

(71) Applicant: Johnson Controls Technology Company, Auburn Hills, MI (US)

(72) Inventors: John L. McElvany, Norman, OK (US); Sriram Ramanujam, Chennai (IN); Uttam Kumar Sharma, Pakur (IN); Curtis A. Trammell, Newcastle, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 104 days.

(21) Appl. No.: 16/002,844

(22) Filed: Jun. 7, 2018

(65) Prior Publication Data

US 2019/0330917 A1 Oct. 31, 2019

Related U.S. Application Data

(60) Provisional application No. 62/663,872, filed on Apr. 27, 2018.

(51) Int. Cl.

| | |
|---|---|
| ***E06B 7/22*** | (2006.01) |
| ***F24F 13/20*** | (2006.01) |
| *E06B 7/23* | (2006.01) |

(52) U.S. Cl.

CPC ..... *E06B 7/22* (2013.01); *F24F 13/20* (2013.01); *F24F 2221/16* (2013.01)

(58) Field of Classification Search

CPC .... E06B 7/22; E06B 7/23; F24F 13/20; F24F 2221/16

USPC ..... 62/259.1

See application file for complete search history.

(56) References Cited

U.S. PATENT DOCUMENTS

| | | | | |
|---|---|---|---|---|
| 3,126,591 A * | 3/1964 | Hamilton | ..... | E06B 7/2318 49/489.1 |
| 5,216,840 A * | 6/1993 | Andrews | ..... | E05B 65/001 114/117 |
| 7,152,375 B1 | 12/2006 | Mastro et al. | | |
| 7,430,835 B1 * | 10/2008 | Larson | ..... | E06B 7/2305 49/400 |

(Continued)

FOREIGN PATENT DOCUMENTS

| | | |
|---|---|---|
| CH | 693964 | 5/2004 |
| CN | 205593140 | 9/2016 |

(Continued)

*Primary Examiner* — Steve S Tanenbaum

(74) *Attorney, Agent, or Firm* — Fletcher Yoder, P.C.

(57) ABSTRACT

The present disclosure relates to an HVAC system door assembly that includes a door that includes a panel having a first side and a second side opposite the first side, and a first seal circuit. The first seal circuit is disposed on the first side. The HVAC system door assembly also includes a door frame that includes a second seal circuit. HVAC system door assembly further includes a ridge projecting from one of the first seal circuit or the second seal circuit configured to align with and engage a central portion of the other of the first seal circuit or the second seal circuit when the door is in a closed position with respect to the door frame. The ridge includes a cross-sectional profile having a flattened peak section with sloping side sections that extend from boundaries of the flattened peak section to a base of the ridge.

20 Claims, 14 Drawing Sheets

(56) References Cited

U.S. PATENT DOCUMENTS

| | | | | |
|---|---|---|---|---|
| 7,451,714 | B1 * | 11/2008 | Redfern | B63B 19/26 114/117 |
| 8,726,575 | B1 * | 5/2014 | Vulpitta | E06B 7/2312 49/470 |
| 2006/0059820 | A1 * | 3/2006 | Peterson | E06B 7/23 52/426 |
| 2007/0074454 | A1 * | 4/2007 | Oomen | B63B 43/24 49/379 |
| 2007/0256363 | A1 * | 11/2007 | Hord | E05C 3/043 49/381 |
| 2011/0105011 | A1 * | 5/2011 | Dubensky | F24F 13/20 454/195 |
| 2016/0273261 | A1 * | 9/2016 | Pardue | E06B 9/00 |

FOREIGN PATENT DOCUMENTS

| | | |
|---|---|---|
| CN | 206816088 | 12/2017 |
| KR | 100991987 | 11/2010 |

* cited by examiner

HVAC SYSTEMS HAVING AIR-TIGHT ACCESS DOORS

CROSS REFERENCE TO RELATED APPLICATION

This application is a Non-Provisional Application claiming priority to U.S. Provisional Application No. 62/663,872, entitled "HVAC SYSTEMS HAVING AIR-TIGHT ACCESS DOORS," filed Apr. 27, 2018, which is hereby incorporated by reference in its entirety for all purposes.

BACKGROUND

The present disclosure relates generally to heating, ventilation, and air conditioning (HVAC) systems and, more particularly, to HVAC systems with air-tight access doors.

Many commercial buildings have one or more air handling units, which are often placed on the roofs of buildings. A typical air handling unit includes an enclosure with one or more access doors to allow personnel to gain access to internal components within the enclosure for visual inspection, service, and replacement of parts, for example. Because the HVAC equipment is used to maintain the building's temperature, it is important that the enclosure, as well as access doors through the enclosure, of the air handling unit are substantially air tight. More specifically, it is beneficial to seal the internal components and compartments within the enclosure against exposure to environmental effects, such as rain, snow, debris, and so forth.

SUMMARY

The present disclosure relates to an HVAC system door assembly that includes a door that includes a panel having a first side and a second side opposite the first side, and a first seal circuit. The first seal circuit is disposed on the first side. The HVAC system door assembly also includes a door frame that includes a second seal circuit. HVAC system door assembly further includes a ridge projecting from one of the first seal circuit or the second seal circuit configured to align with and engage a central portion of the other of the first seal circuit or the second seal circuit when the door is in a closed position with respect to the door frame. The ridge includes a cross-sectional profile having a flattened peak section with sloping side sections that extend from boundaries of the flattened peak section to a base of the ridge.

The present disclosure also relates to an HVAC unit that includes an enclosure that includes a plurality of walls. The HVAC unit also includes a door assembly disposed in one of the plurality of walls. The door assembly includes a door that includes a gasket disposed on a face of the door and forming a first circuit. The door assembly also includes a door frame that includes a ridge that projects from a side of the door frame and forms a second circuit. The ridge is positioned on the side of the door frame such that the ridge and the gasket are configured to align and engage when the door is in a closed position with respect to the door frame. In addition, the ridge includes a cross-sectional profile having a flattened peak section with sloping side sections that extend from boundaries of the flattened peak section to the side of the door frame.

The present disclosure further relates to an HVAC unit that includes an enclosure that includes a plurality of walls. The HVAC unit also includes a door assembly disposed in one of the plurality of walls. The door assembly includes a door frame, a gasket disposed on a face of the door frame and forming a first circuit, and a door hingedly coupled to the door frame. The door assembly also includes a ridge projecting from a side of the door and forming a second circuit. The ridge includes a cross-sectional profile having a flattened peak section with sloping side sections that extend from boundaries of the flattened peak section to the side of the door.

DETAILED DESCRIPTION

In HVAC systems, air-tight sealing of an enclosure of an HVAC system is often provided by attaching a gasket near a perimeter of an access door and securing the access door against a door frame of the enclosure using latches. In this way, the gasket is compressed between the door frame and the access door to create a seal. However, often, the latches may distribute force across an entire area of the gasket, such that the force may not sufficiently transfer to far ends of the door to stop air leakage through the access door.

The present disclosure is directed to HVAC systems and units that include access doors that provide relatively air-tight sealing compared to conventional access doors. In particular, certain embodiments described herein include access door assemblies having door frames with ridges that project from sides of the door frames, and which are configured to align with gaskets of doors of the access door assemblies, such that the ridges of the door frames generally align with the gaskets of the doors when the doors are in closed positions with respect to their respective door frames. The interaction between the ridges of the door frames and the gaskets of the doors provides improved sealing between the doors and the door frames. In addition, the ridges of the door frames improve the rigidity of the door frames, thereby obviating the need for extra stiffening supports, such as flanges and ribs.

Figure 1:
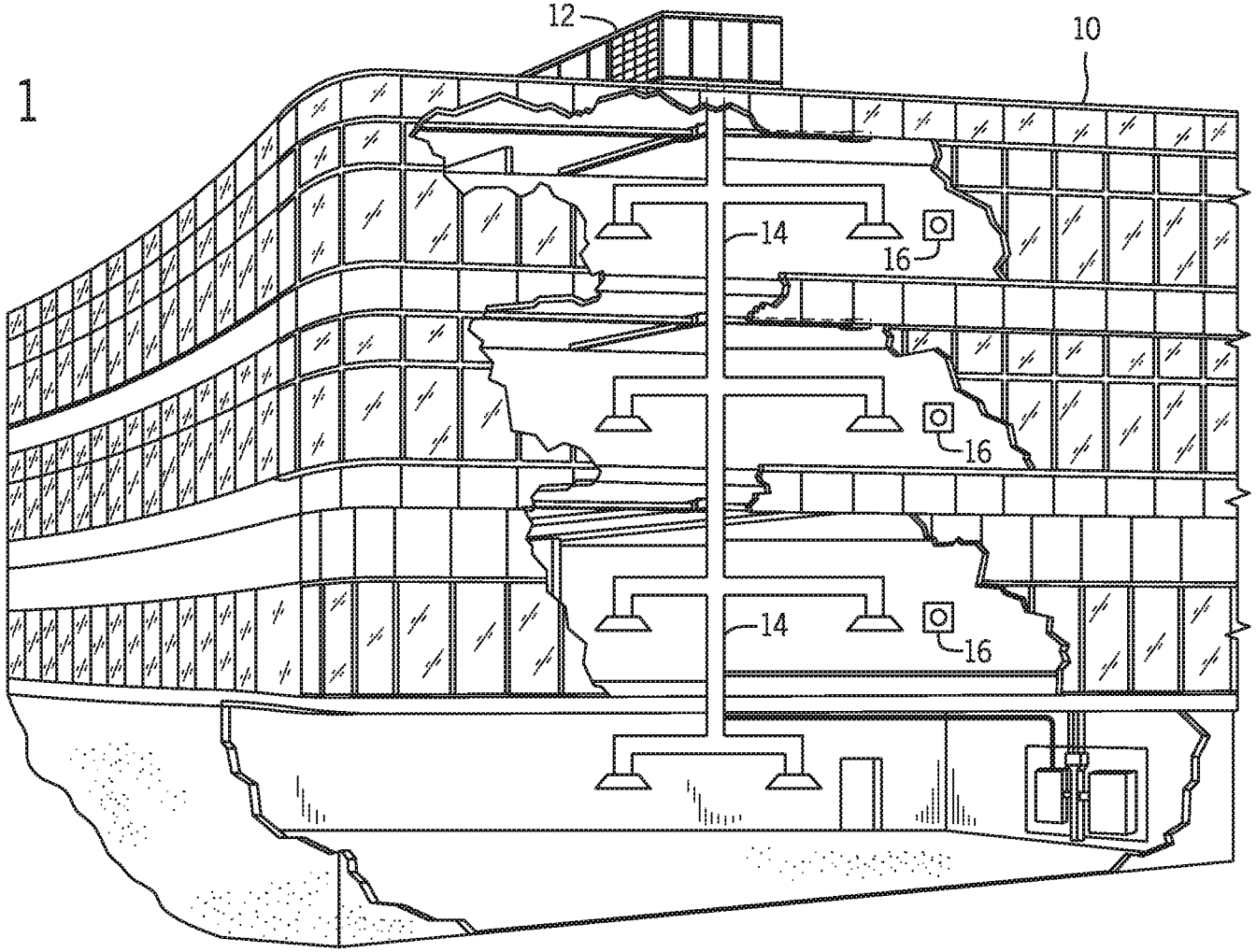
FIG. 1 is an illustration of an embodiment of a commercial or industrial HVAC system, in accordance with the present techniques.

Turning now to the drawings, FIG. 1 illustrates an HVAC system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
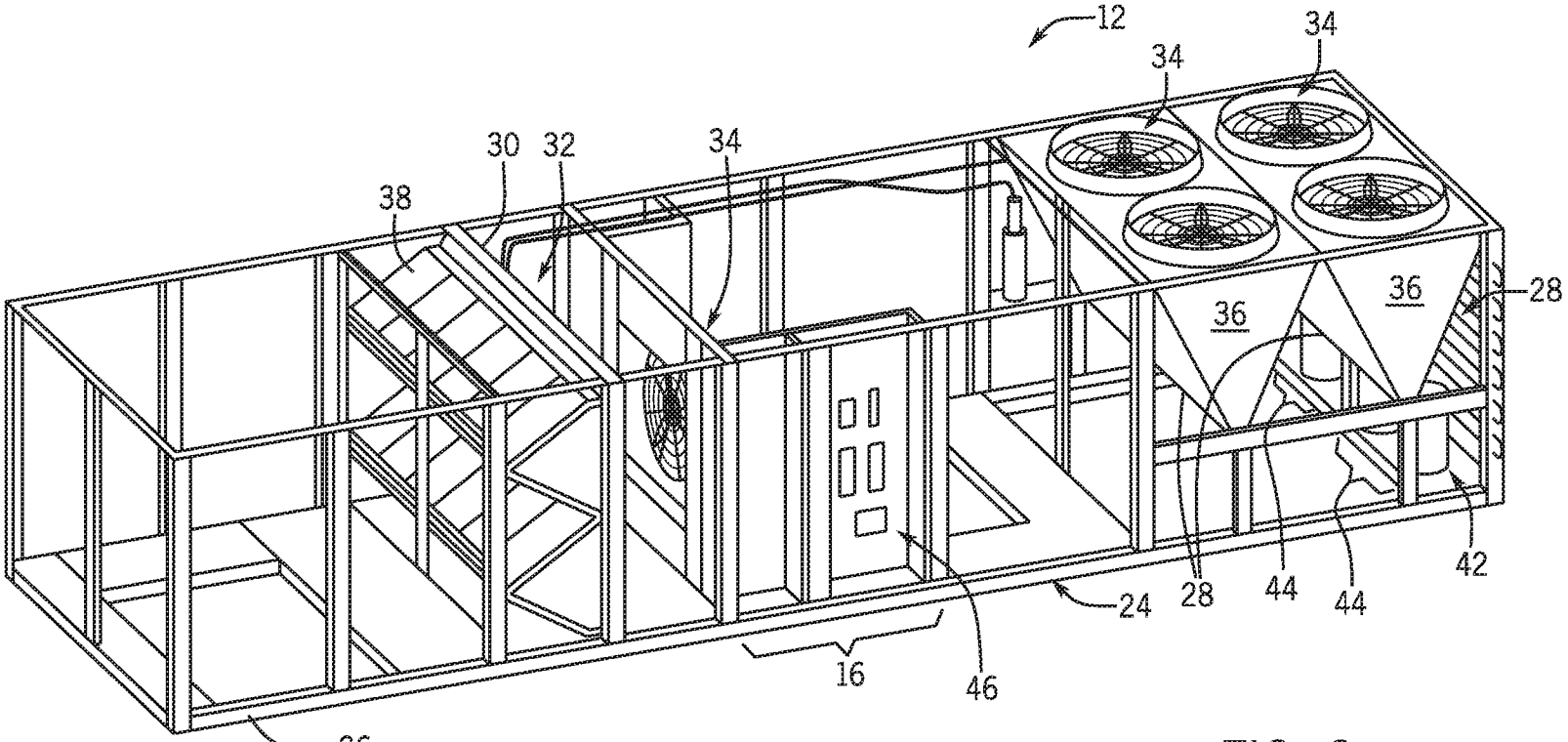
FIG. 2 is an illustration of an embodiment of a portion of a packaged unit of the HVAC system shown in FIG. 1, in accordance with the present techniques.

FIG. 2 is a perspective view of an embodiment of a portion of the HVAC unit 12. For example, the portion of the HVAC unit 12 illustrated in FIG. 2 has certain features removed for clarity, including the side walls and roof that surround a cabinet of the HVAC unit 12, and which provide protection for the internal compartments and components of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 32 that separates the heat exchanger 30 from the heat exchanger 28. Fans 34 draw air from the environment through the heat exchanger 28, where the heat exchanger 28 may be framed within the cabinet 24 of the HVAC unit 12 and/or containers 36 below the fans 34. Air may be heated and/or cooled as the air flows through the heat exchanger 28 before being released back to the environment surrounding the rooftop unit 12. A blower assembly 34, powered by an associated motor, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. In the illustrated embodiment, the compressors 42 include two dual stage configurations 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block associated with the illustrated control board 46. For example, a high voltage power source may be connected to the terminal block to power the equipment. The operation of the HVAC unit 12 may be governed or regulated by the control board 46. The control board 46 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring may connect the control board 46 and the terminal block to the equipment of the HVAC unit 12.

Figure 5:
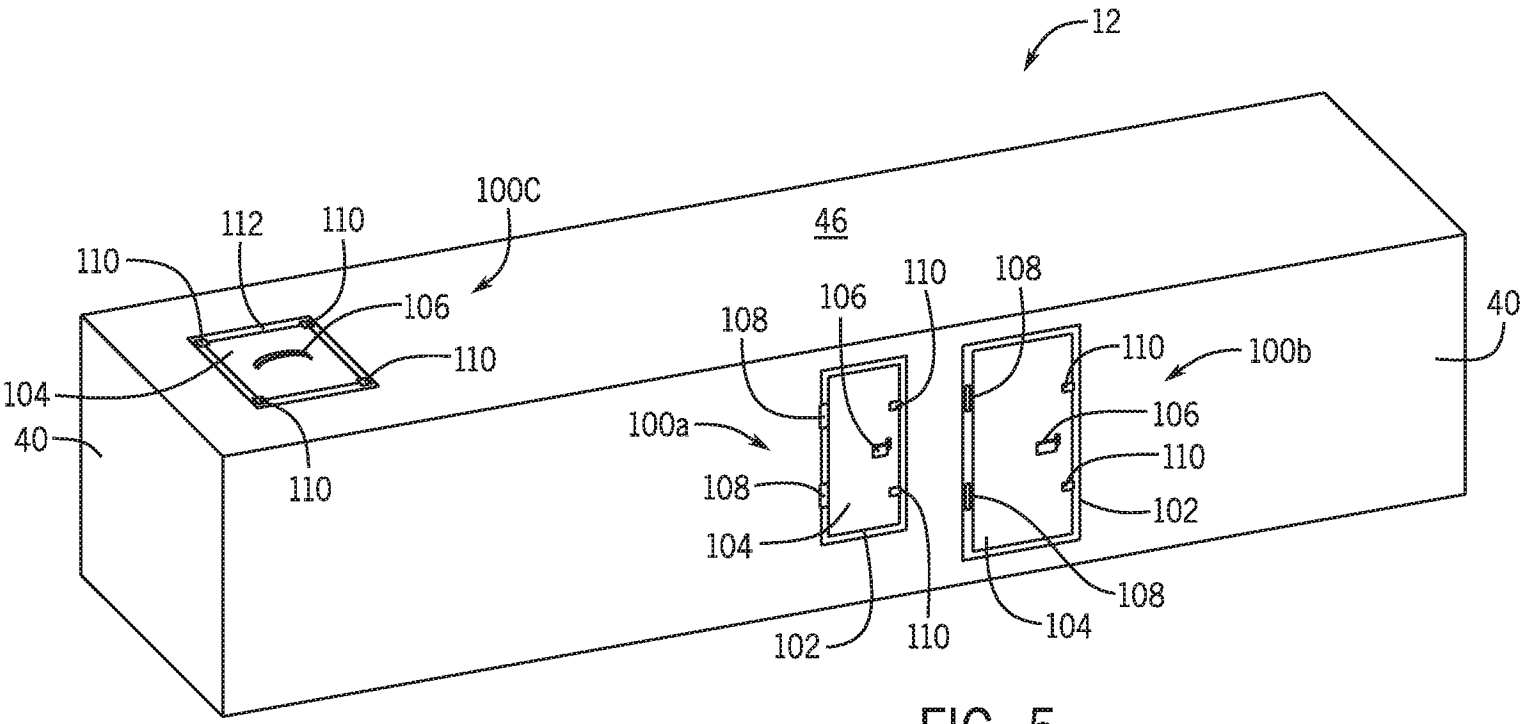
FIG. 5 is an illustration of an embodiment of the packaged unit of the HVAC system shown in FIG. 1, in accordance with the present techniques.

As described in greater detail herein, in certain embodiments, the HVAC unit 12 may also include access doors located in side walls and/or a roof of the HVAC unit 12, which enable access to internal compartments and components of the HVAC unit 12. For example, FIG. 5 is a perspective view of an embodiment of the HVAC unit 12 illustrated in FIG. 2, with the side walls, roof, and various air-tight access doors as described herein. However, it will be appreciated that the air-tight access doors described herein may be used in any HVAC systems, with the HVAC systems described herein merely being exemplary of the types of HVAC systems that may benefit from the air-tight access doors described herein.

Figure 3:
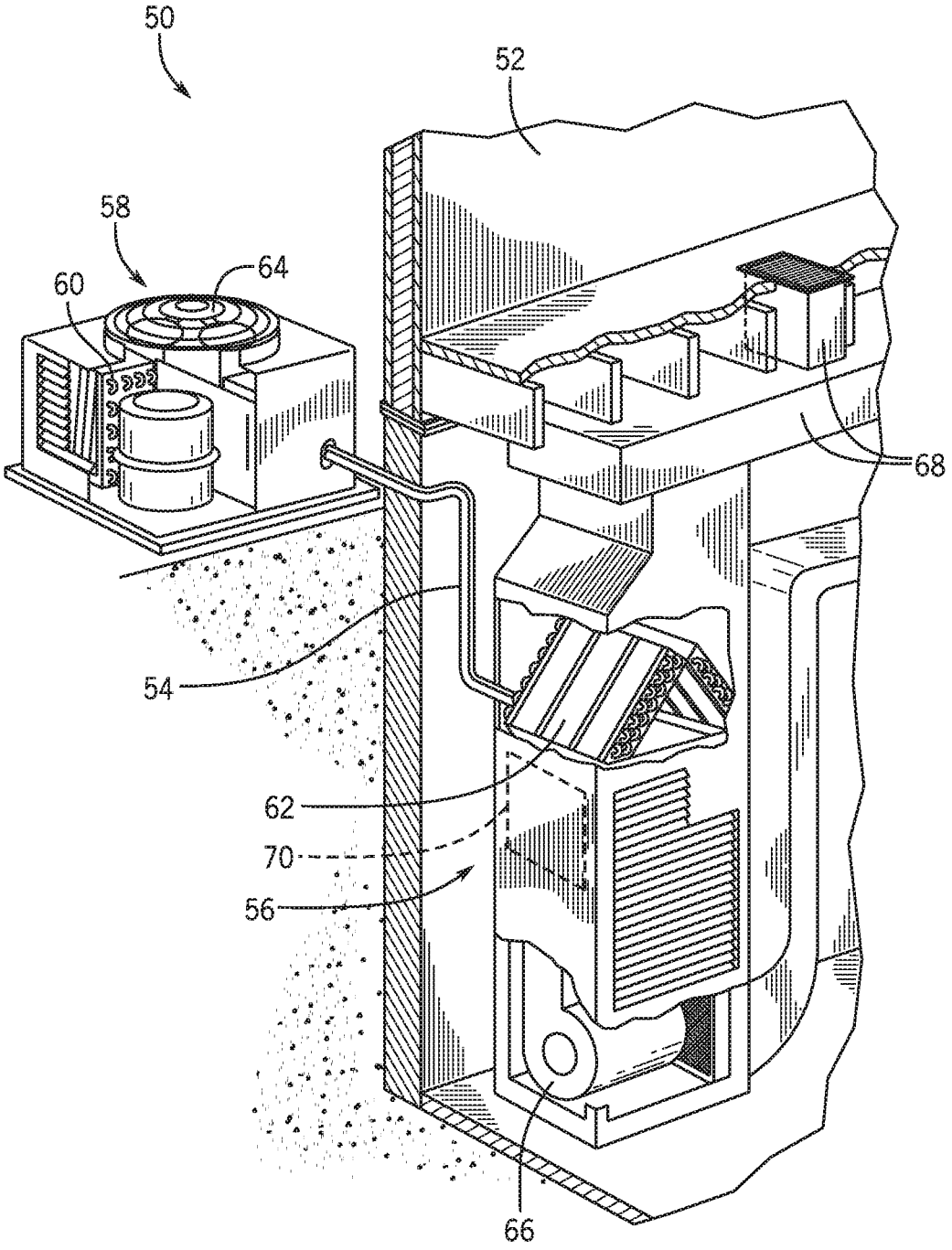
FIG. 3 is an illustration of an embodiment of a split system of the HVAC system shown in FIG. 1, in accordance with the present techniques.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
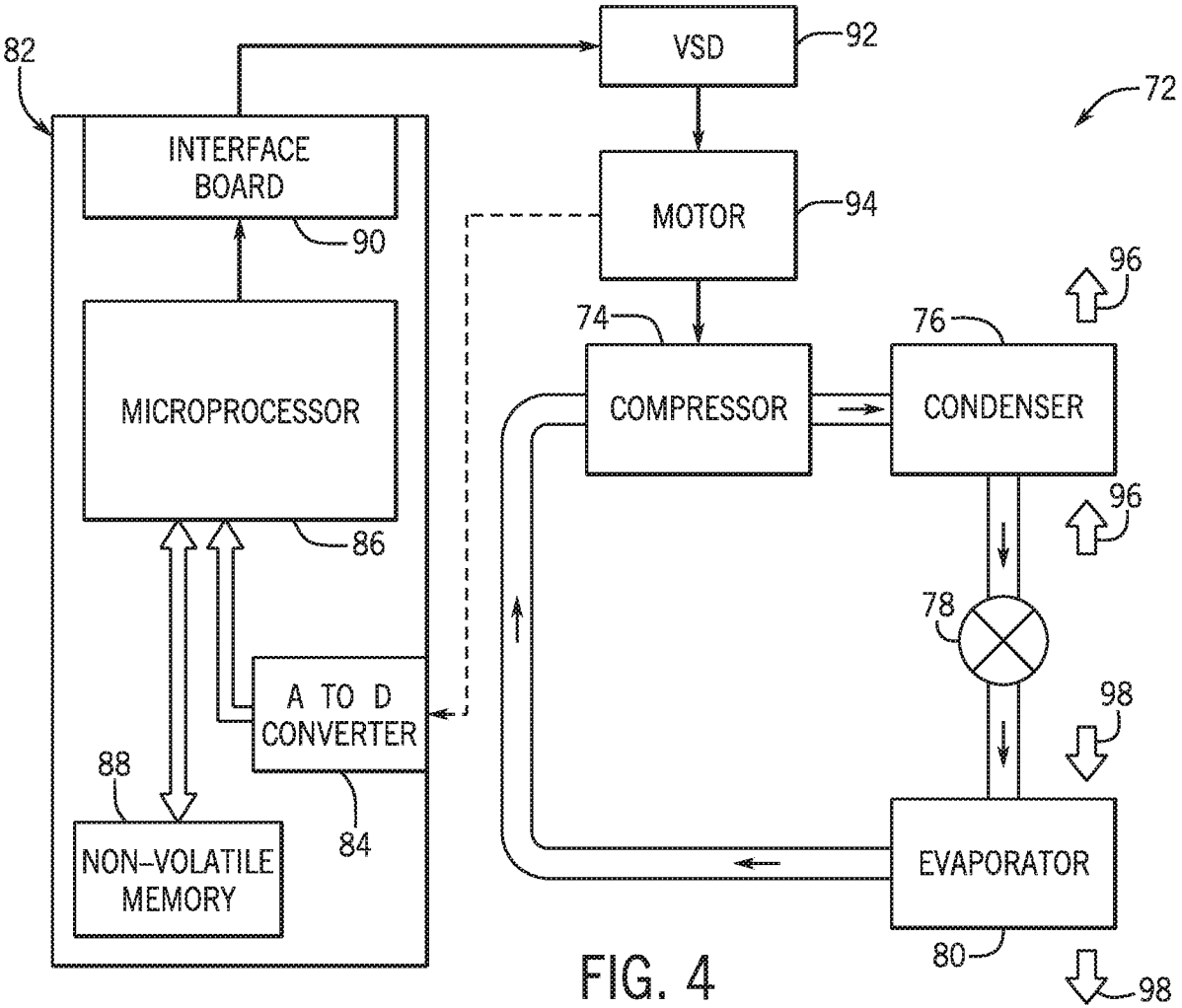
FIG. 4 is an illustration of an embodiment of a refrigeration system of the HVAC system shown in FIG. 1, in accordance with the present techniques.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Further, in accordance with present techniques, the HVAC systems described herein may utilize access doors as described herein to provide improved sealing, thereby minimizing exposure of the internal compartments and components of the HVAC system to environmental effects, such as rain, snow, debris, and so forth. For example, FIG. 5 is a perspective view of an embodiment of the packaged HVAC unit 12 illustrated in FIG. 2, with side walls 40 and a roof 46 shown around the cabinet 24 of the HVAC unit 12 for illustration. In particular, the side walls 40 and the roof 46 collectively form an enclosure for the HVAC unit 12, with the roof being a fifth wall. As illustrated, the HVAC unit 12 may include various access door assemblies 100 that enable access to the internal compartments and components of the HVAC unit 12, while also providing improved sealing.

As illustrated in FIG. 5, in certain embodiments, the access door assemblies 100 may include door frames 102, which may be installed within, for example, mounted into appropriately sized door frame openings through, the side walls 40 and/or the roof 46, and the access doors 104 that are configured to open with respect to their respective door frames 102, thereby enabling access to the internal compartments and components of the HVAC unit 12. In particular, the access door assemblies 100 may include various handles 106 that facilitate opening of the access doors 104 with respect to their respective door frames 102. As also illustrated in FIG. 5, while primarily described herein as including hinged access door assemblies 100, such as the access door assemblies 100*a*, 100*b* having access doors 104 that are hinged to their respective door frames 102 via one or more hinges 108, in other embodiments, the access doors 104 of the access door assemblies 100*c* may simply be removable from their respective door frames 102 where, for example, the access door 104 may be placed aside once removed from its respective door frame 102. Regardless, as also illustrated in FIG. 5, in certain embodiments, once the access door 104 has been closed with respect to its door frame 102, the access door 102 may be latched or locked into place in the closed position via one or more latches 110, which are often located on a side of the respective access door 104 opposite the one or more hinges 108. As illustrated, in certain embodiments, the one or more latches 110 may include accessible actuation mechanisms disposed on a side of the access door 104 opposite the door frame 102.

As also illustrated in FIG. 5, the access door assemblies 100 may be used for myriad types of access into the HVAC unit 12. For example, in certain embodiments, the access door assemblies 100 may only enable access to internal components of the HVAC unit 12. For example, the access door assembly 100*a* in FIG. 5 may enable access to the control board 46 illustrated in FIG. 2. However, in other embodiments, the access door assemblies 100 may enable access to entire internal compartments of the HVAC unit 12. For example, the access door assembly 100*b* illustrated in FIG. 5 may enable personnel to physically enter one or more internal compartments of the HVAC unit 12.

Figure 6B:
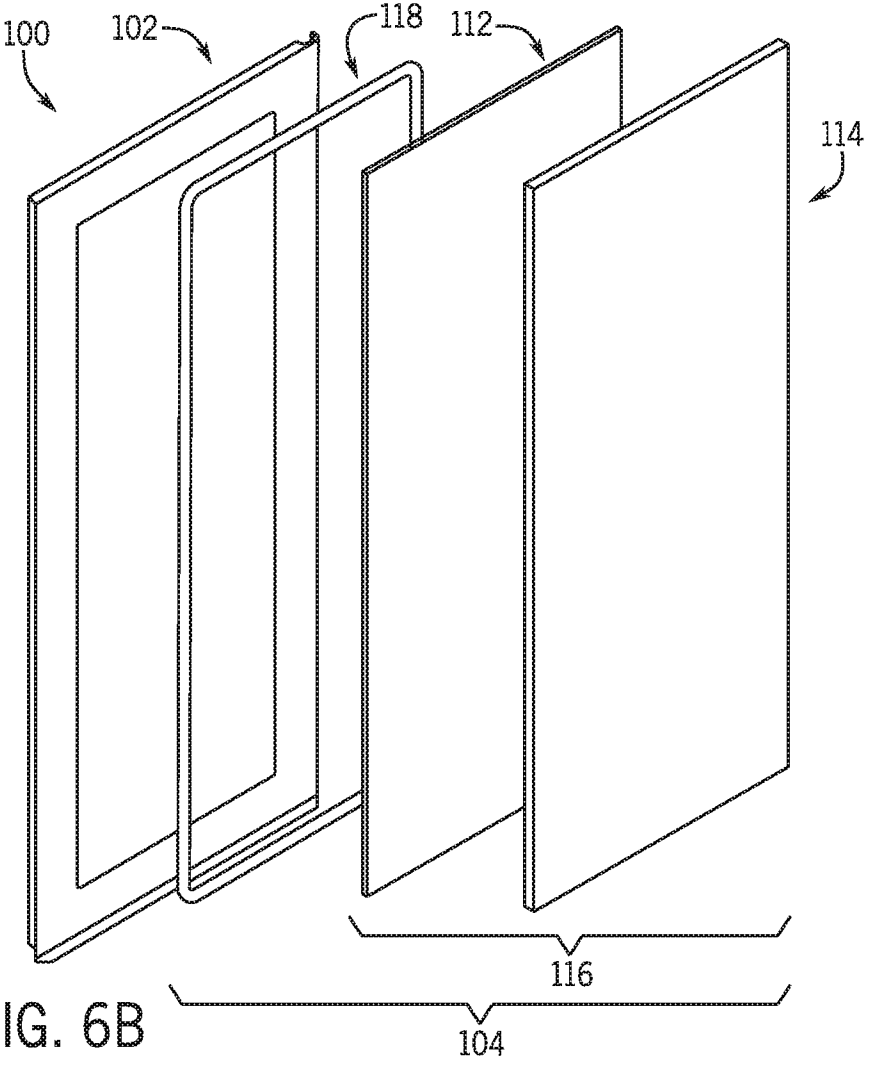
FIG. 6B is an exploded view of the access door assembly shown in FIG. 6A, in accordance with the present techniques.
Figure 6A:
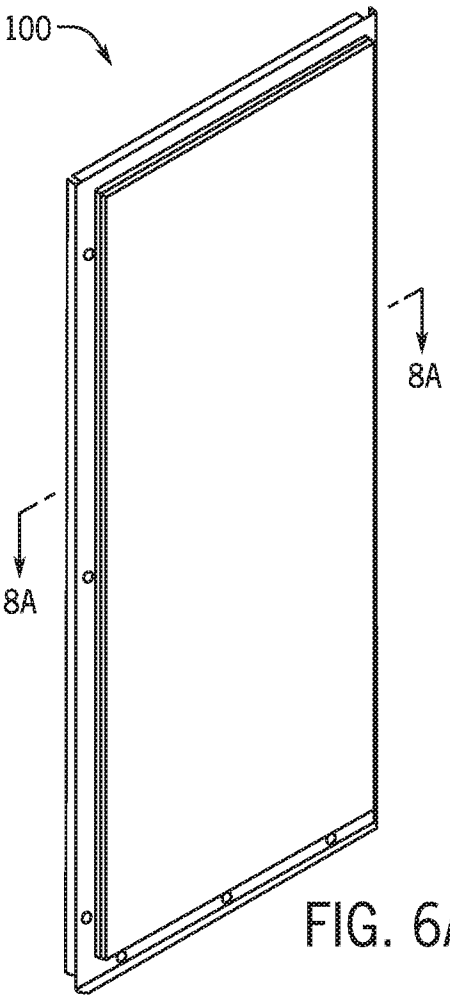
FIG. 6A is a perspective view of an embodiment of an access door assembly, in accordance with the present techniques.

FIG. 6A is a perspective view of an embodiment of an access door assembly 100, in accordance with the present techniques. In addition, FIG. 6B is an exploded view of the embodiment of the access door assembly 100 shown in FIG. 6A, in accordance with the present techniques. As illustrated, in certain embodiments, the access door assembly 100 includes a door frame 102, a door inner wall 112 and a door outer wall 114, which collectively form a door wall 116, and a gasket 118 positioned between the door frame 102 and the door inner wall 112. In particular, the gasket 118 may be affixed to the door inner wall 112, and the door inner wall 112 may be affixed to the door outer wall 114 to form the integrated door wall 116 to form the access door 104. More specifically, the gasket 118 may be affixed to a side, or face, of the door inner wall 112 opposite the door outer wall 114 near a perimeter, circumference, periphery, or edge of the door wall 116. The gasket 118 may be affixed to the door inner wall 112 in myriad ways including, but not limited to, being integral with the door inner wall 112, having the door inner wall 112 overmolded around the gasket 118, having the gasket 118 disposed in slot or groove cut into the door inner wall 112, and so forth. As illustrated, in certain embodiments, the gasket 118 forms a seal circuit that extends around the side of the door inner wall 112 proximate the perimeter of the door wall 116. In certain embodiments, the gasket 118 may not form a complete circuit around the side of the door inner wall 112, but may instead be interrupted by one or more gaps or other discontinuities. In certain embodiments, the gasket 118 may be a band of flexible material, such as high density urethane, configured to deform when the gasket 118 interacts with a side 120 (or face) of the door frame 102.

As illustrated, the door inner wall 112 and the door outer wall 114 both include solid, generally rectangular bodies that do not have openings therethrough. In contrast, as also illustrated, the door frame 102 and the gasket 118 are also generally rectangular in shape, but include generally rectangular openings that generally align with each other. In particular, the gasket 118 is generally shaped such that, when it is affixed to the door inner wall 112 and attached to the door frame 102, for example, via one or more of the hinges 108 described herein, the gasket 118 is configured to be compressed against the door frame 102 when the access door 104 is in a closed position with respect to the door frame 102 and, for example, latched into the closed position via the one or more latches 110 described herein, to achieve air-tight sealing. In such an embodiment, the one or more hinges 108 and the one or more latches 110 generally provide the force to compress the gasket 118 against the door frame 102.

Figure 7B:
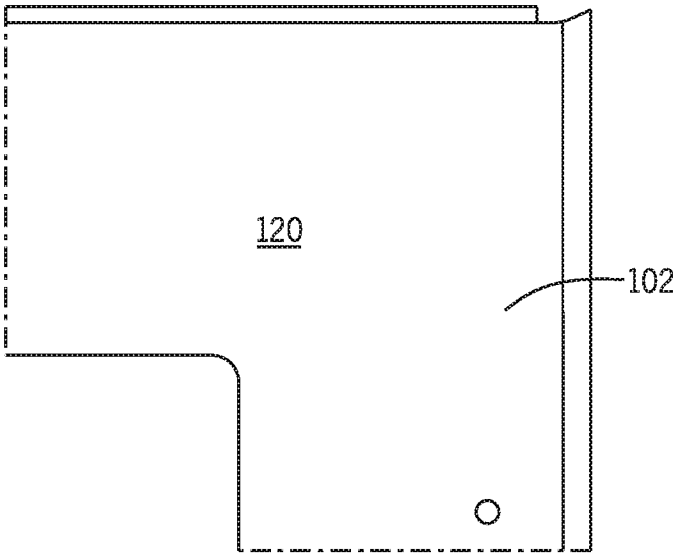
FIG. 7B is a zoomed in perspective view of a portion of a door frame of the access door assembly shown in FIG. 7A, in accordance with the present techniques.
Figure 7A:
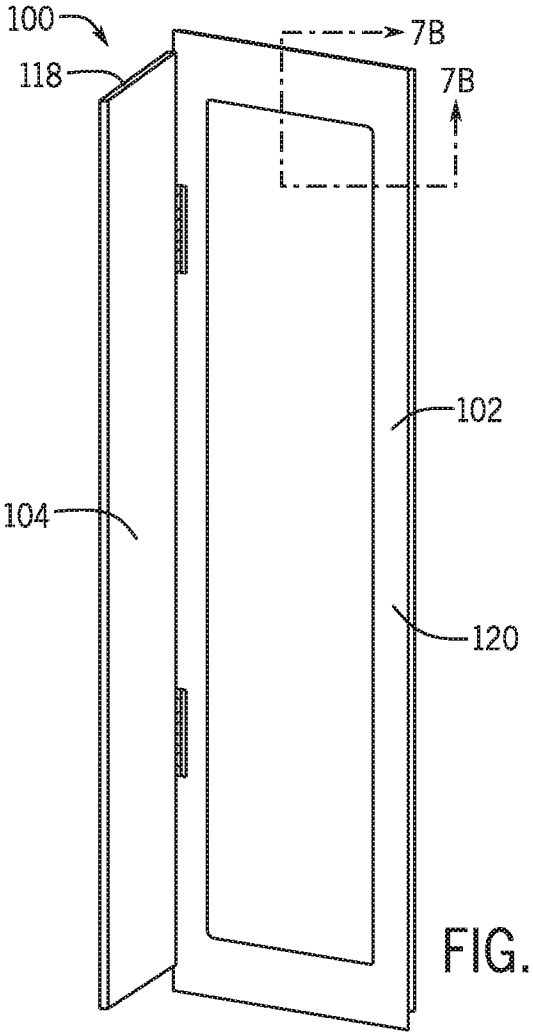
FIG. 7A is a perspective view of an embodiment of the access door assembly shown in FIG. 6A, with the access door in an opened position, in accordance with the present techniques.

FIG. 7A is a perspective view of an embodiment of the access door assembly 100 shown in FIG. 6A, with the access door 104 in an opened position, in accordance with the present techniques. In addition, FIG. 7B is a zoomed in perspective view of a portion of a door frame 102 of the access door assembly 100 shown in FIG. 7A, in accordance with the present techniques. As illustrated, in certain embodiments, the side 120 of the door frame 102 that interfaces with the gasket 118 is substantially flat. As used herein, the term "substantially flat" or "substantially linear" is intended to be interpreted as a flat surface or line within reasonable manufacturing tolerances, for example, having greater than 95%, greater than 98%, greater than 99%, or even more, of the individual points on the substantially flat surface or line, such as on the side 120 of the door frame 102, that exist in a single plane. As such, when the gasket 118 compresses against the side 120 of the door frame 102, the force exerted from the gasket 118 against the side 120 of the door frame 102 is distributed substantially evenly across the entire area of the gasket 118.

Figure 8C:
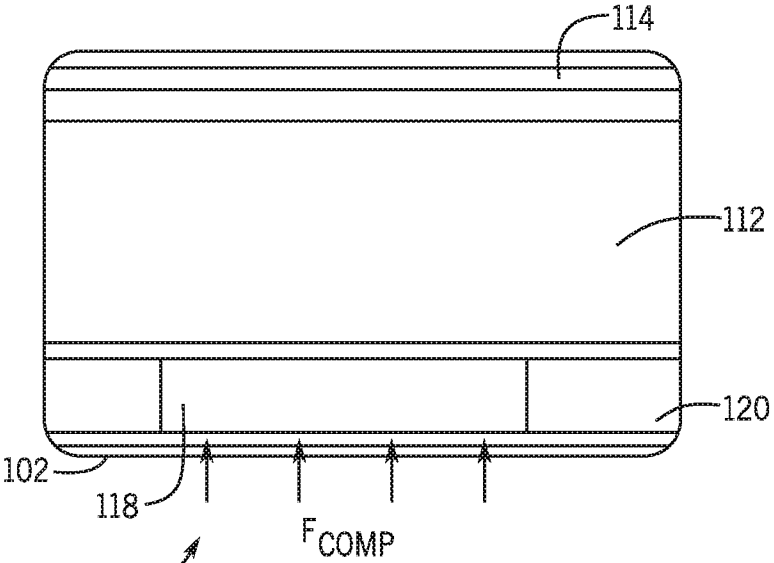
FIGS. 8B and 8C are cross-sectional cutaway views of the access door assembly shown in FIG. 8A, in accordance with the present techniques.
Figure 8B:
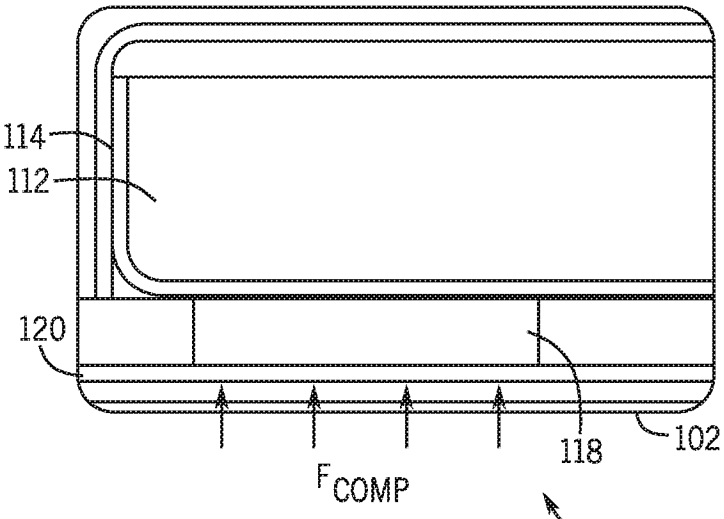
Figure 8A:
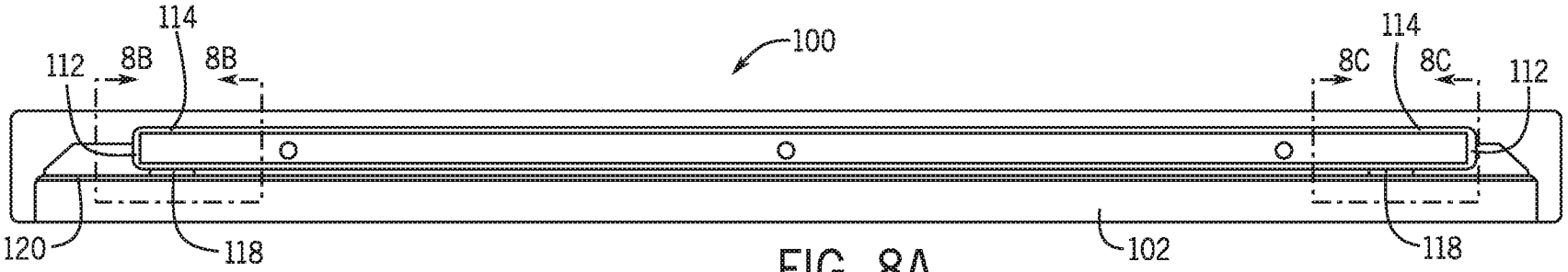
FIG. 8A is a cross-sectional cutaway view of an embodiment of the access door assembly shown in FIG. 6A, in accordance with the present techniques.

FIG. 8A a cross-sectional cutaway view of an embodiment of the access door assembly 100 shown in FIG. 6A, in accordance with the present techniques. In addition, FIGS. 8B and 8C are cross-sectional cutaway views of the access door assembly 100 shown in FIG. 8A, in accordance with the present techniques. FIGS. 8B and 8C illustrate how the forces of compression $F_{comp}$ between the gasket 118 and the substantially flat side 120 of the door frame 102 are substantially evenly distributed across the entire area of the gasket 118. For example, in certain embodiments, the forces of compression $F_{comp}$ between the gasket 118 and the substantially flat side 120 of the door frame 102 may vary by less than 5%, less than 2%, less than 1%, or even less, for any two points of contact between the gasket 118 and the flat side 120 of the door frame 102.

The access door assemblies 100 illustrated in FIGS. 6-8 provide certain advantages relating to creating air-tight sealing between the gasket 118 and the door frame 102. However, it has been recognized that points of contact between the gasket 118 and the door frame 102 that are further away from the latch and hinge mounting points may experience reduced forces of compression $F_{comp}$ between the gasket 118 and the door frame 102, thereby leading to diminished sealing at this points. Furthermore, it has been recognized that it would be advantageous to minimize the reliance on hinges 108 and latches 110 to generate the forces of compression $F_{comp}$ between the gasket 118 and the door frame 102.

Figure 9B:
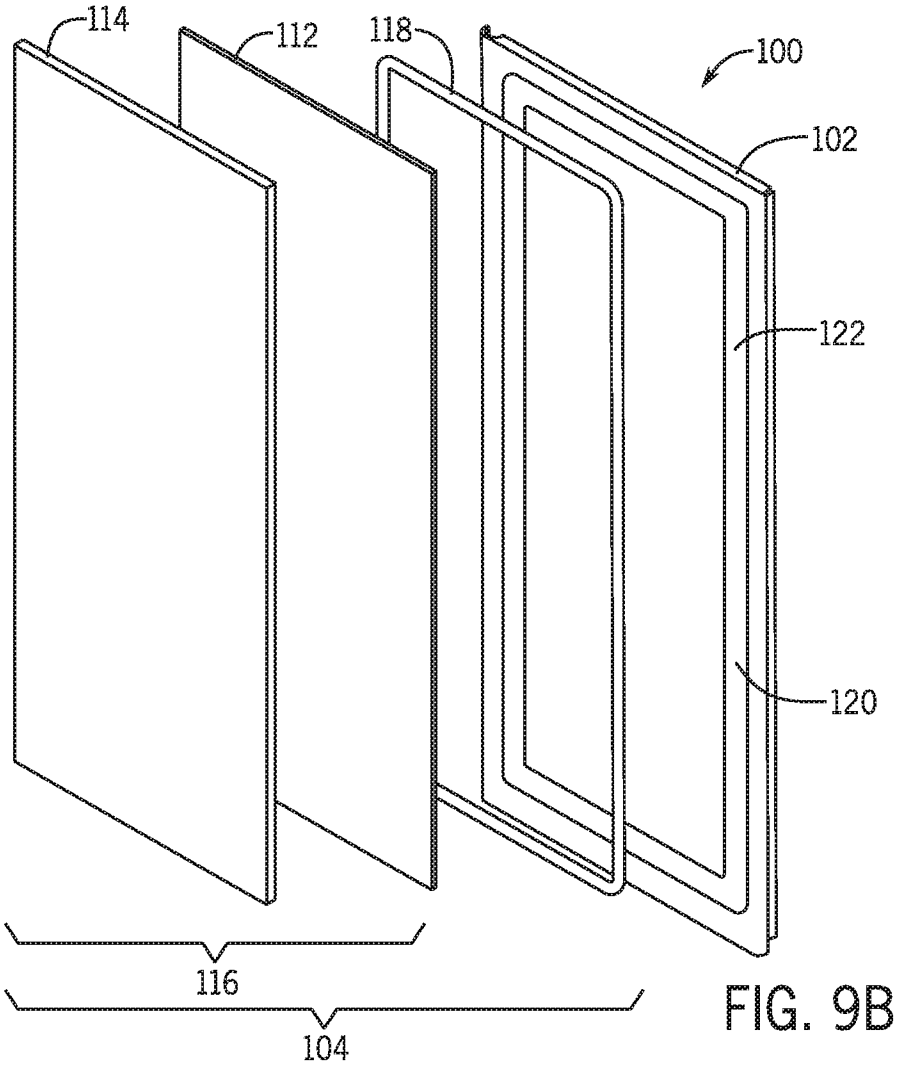
FIG. 9B is an exploded view of the access door assembly shown in FIG. 9A, in accordance with the present techniques.
Figure 9A:
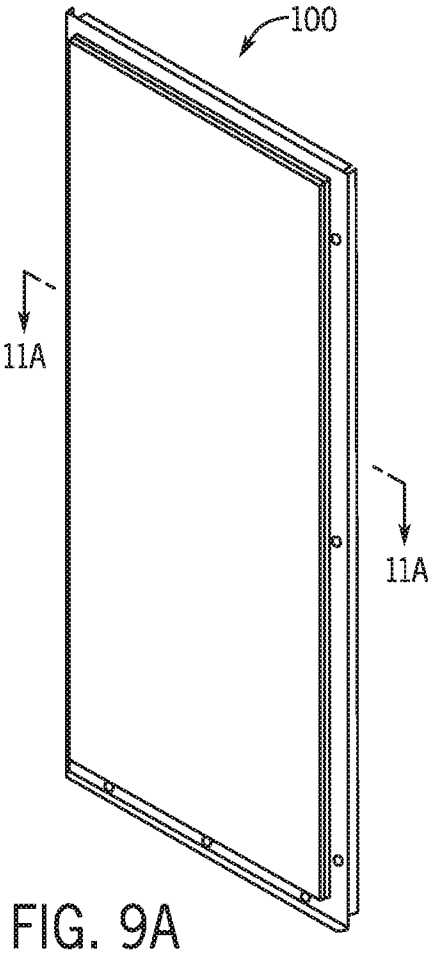
FIG. 9A is a perspective view of another embodiment of an access door assembly, in accordance with the present techniques.

FIG. 9A is a perspective view of another embodiment of an access door assembly 100, in accordance with the present techniques. In addition, FIG. 9B is an exploded view of the embodiment of the access door assembly 100 shown in FIG. 9A, in accordance with the present techniques. The embodiment illustrated in FIGS. 9A and 9B is substantially similar to the embodiment illustrated in FIGS. 6A and 6B, except for the fact that, instead of being substantially flat, the side 120 of the door frame 102 includes a ridge 122 that projects outwardly from the side 120 of the door frame 102. In general, the projected ridge 122 of the door frame 102 is configured such that it generally aligns with the gasket 118 of the access door 104 when the access door 104 is in a closed position with respect to the door frame 102 and, for example, latched into the closed position via the one or more latches 110 described herein, to achieve air-tight sealing. As illustrated, in certain embodiments, the projected ridge 122 forms a second seal circuit that extends around the side 120 of the door frame 102. In certain embodiments, the projected ridge 122 may not form a complete circuit around the side 120 of the door frame 102, but may instead be interrupted by one or more gaps or other discontinuities. In certain embodiments, the door frame 102, and the projected ridge 122 formed in the door frame 102, may be comprised of a rigid material, such as metal, whereby interaction of the projected ridge 122 with the gasket 118 at, for example, a center portion of the gasket 118 causes the gasket 118 to deform. In certain embodiments, the gasket 118 may have a width that is greater than projected ridge 122, while in other embodiments, the projected ridge 122 may have a width that is greater than the gasket 118.

Figure 10B:
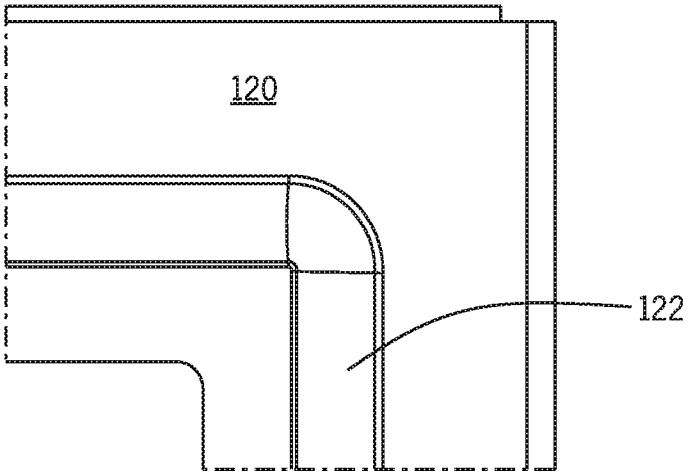
FIG. 10B is a zoomed in perspective view of a portion of a door frame of the access door assembly shown in FIG. 10A, in accordance with the present techniques.
Figure 10A:
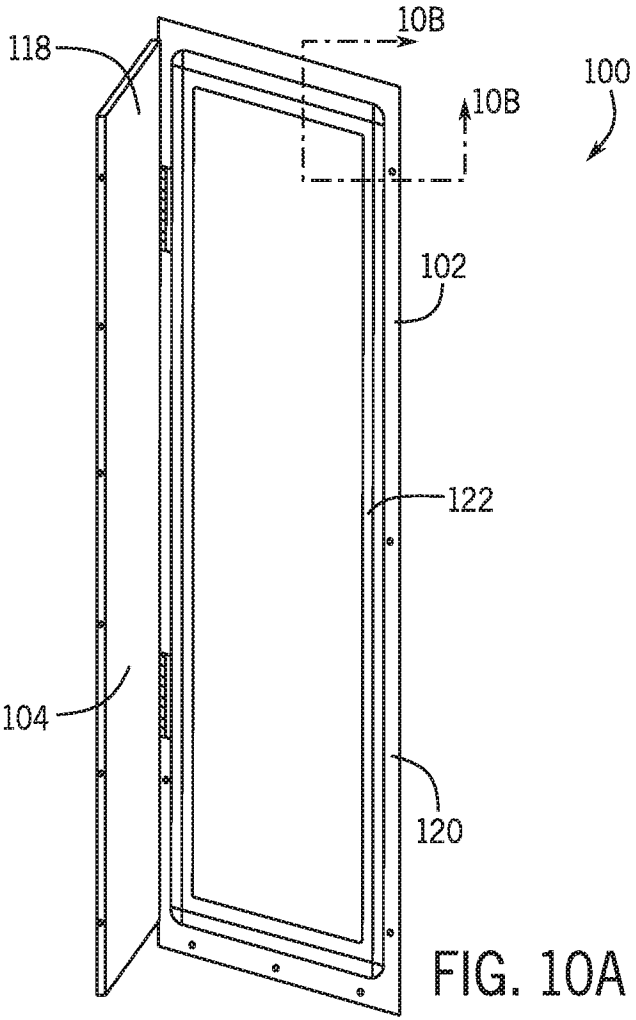
FIG. 10A is a perspective view of an embodiment of the access door assembly shown in FIG. 9A, with the access door in an opened position, in accordance with the present techniques.

FIG. 10A is a perspective view of an embodiment of the access door assembly 100 shown in FIG. 9A, with the access door 104 in an opened position, in accordance with the present techniques. In addition, FIG. 10B is a zoomed in perspective view of a portion of a door frame 102 of the access door assembly 100 shown in FIG. 10A, in accordance with the present techniques. As illustrated, in certain embodiments, the side 120 of the door frame 102 that interfaces with the gasket 118 is not substantially flat, but includes the ridge 122, which projects from the side 120 of the door frame 102, and which is configured to generally align with and engage a central portion of the gasket 118 of the access door 104 when the access door 104 is in a closed position with respect to the door frame 102 and, for example, latched into the closed position via the one or more latches 110 described herein, to achieve air-tight sealing. As such, in this embodiment, the one or more hinges 108 and the one or more latches 110 are not the only components that generate the forces of compression $F_{comp}$ between the gasket 118 and the door frame 102. Rather, the projected ridge 122 helps generate additional forces of compression $F_{comp}$ between the gasket 118 and the door frame 102. Furthermore, due at least in part to the non-flat shape of the projected ridge 122, the forces of compression $F_{comp}$ exerted from the gasket 118 against the projected ridge 122 of the door frame 102 are not distributed evenly across the entire area of the gasket 118.

Figure 11C:
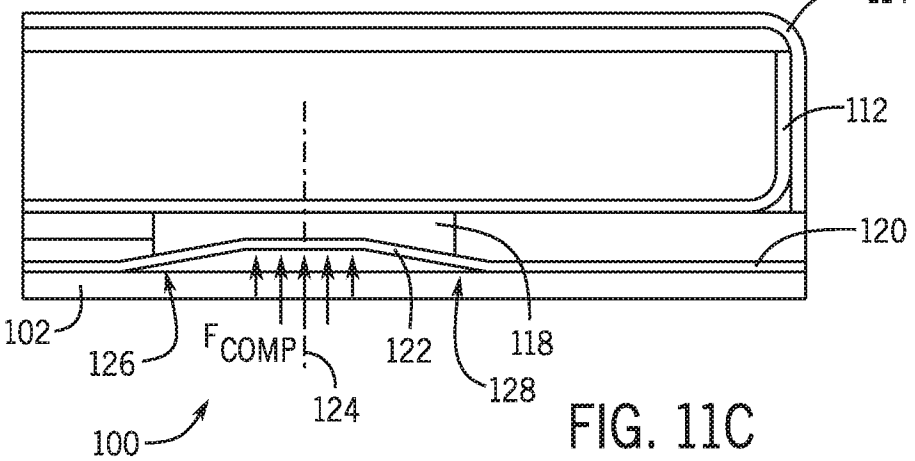
FIGS. 11B and 11C are cross-sectional cutaway views of the access door assembly shown in FIG. 11A, in accordance with the present techniques.
Figure 11B:
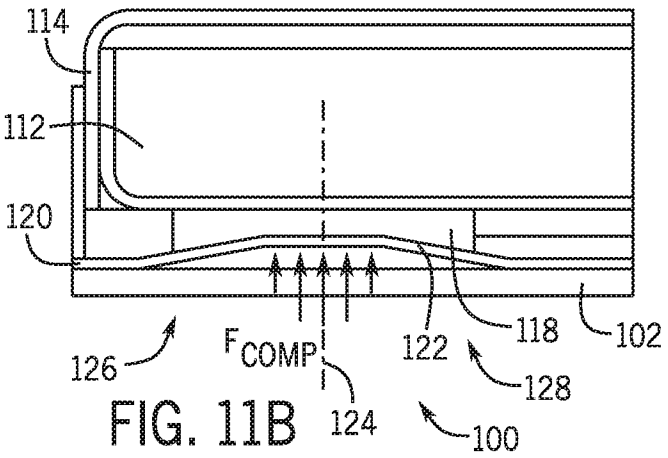
Figure 11A:
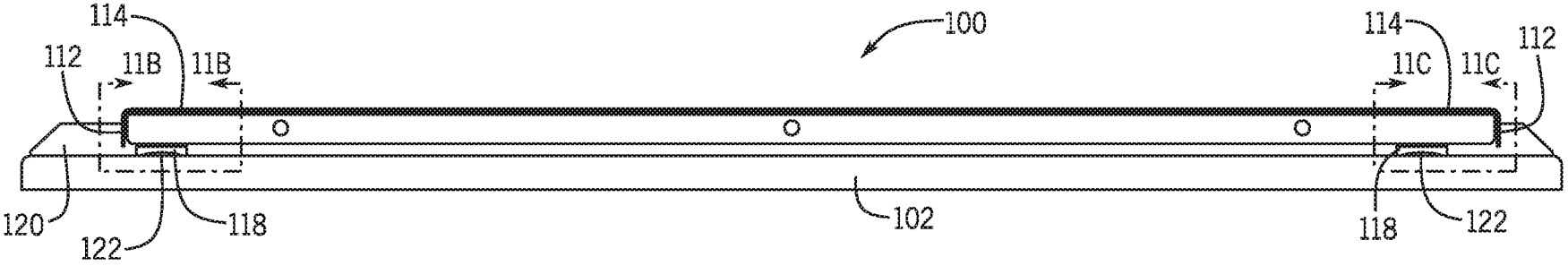
FIG. 11A is a cross-sectional cutaway view of an embodiment of the access door assembly shown in FIG. 9A, in accordance with the present techniques.

FIG. 11A a cross-sectional cutaway view of an embodiment of the access door assembly 100 shown in FIG. 9A, in accordance with the present techniques. In addition, FIGS. 11B and 11C are cross-sectional cutaway views of the access door assembly 100 shown in FIG. 11A, in accordance with the present techniques. FIGS. 11B and 11C illustrate how the forces of compression $F_{comp}$ between the gasket 118 and the projected ridge 122 of the door frame 102 are not distributed evenly across the entire area of the gasket 118. For example, as illustrated, in certain embodiments, the forces of compression $F_{comp}$ between the gasket 118 and the projected ridge 122 of the door frame 102 may be greater at a centerline 124 of an area of the gasket 118. For example, in certain embodiments, the forces of compression $F_{comp}$ between the gasket 118 and the projected ridge 122 of the door frame 102 at the centerline 124 of the cross-sectional area of the gasket 118 may be greater than the forces of compression $F_{comp}$ between the gasket 118 and the projected ridge 122 of the door frame 102 at the edges 126, 128 of the cross-sectional area of the gasket 118 by greater than 10%, greater than 20%, greater than 30%, greater than 40%, greater than 50%, greater than 60%, greater than 70%, greater than 80%, greater than 90%, greater than 100%, or even more, depending on the specific physical dimensions of the gasket 118 and the projected ridge 122. The concentration of the forces of compression $F_{comp}$ between toward the centerline 124 of the gasket 118 results in deeper penetration of the projected ridge 122 into the gasket 118, thereby providing improved sealing as compared to conventional techniques.

In addition, the projected ridge 122 makes initial contact with the gasket 118 and begins sealing before the access door 104 is latched against the door frame 102, for example, via the one or more latches 110 described herein. Once the one or more latches 110 are activated, the force exerted by the one or more latches 110 is distributed along the perimeter of the access door 104 from the gasket 118 to the projected ridge 122 for an improved sealing effect, with very little increase in cost. In particular, the projected ridge 122 may be formed in an existing door frame 102 using relatively easy manufacturing processes, such as turret presses. In addition, the projected ridge 122 provides increased rigidity for the door frame 102, obviating the need for additional stiffening support structures, such as flanges and ribs, thereby eliminating additional costs relating to such support structures.

It should be noted that while the embodiments described herein have been primarily directed to access doors 104 having the gaskets 118 attached thereto, and the projected ridges 122 being formed in the door frames 102, in other embodiments, the gaskets 118 and projected ridges 122 may be associated with the opposite components of the access door assemblies 100. For example, in certain embodiments, the gasket 118 may be attached to the door frame 102 in the manner described herein, and the projected ridge 122 may be formed in the access door 104, specifically in the door inner wall 112 of the door wall 116 of the access door 104, in the manner described herein. It will be appreciated that, in such embodiments, the interaction between the gasket 118 and projected ridge 122 are substantially similar to the interaction between the gasket 118 and projected ridge 122 for the other embodiments described herein.

The projected ridges 122 illustrated in FIGS. 6-11 are merely exemplary of the types of projected ridges 122 that may be used. More specifically, the projected ridge 122 may include various cross-sectional profiles. FIGS. 12A through 12I are cross-sectional views of profiles of various embodiments of the projected ridge 122, in accordance with the present techniques. In general, each of the illustrated embodiments includes a cross-sectional profile having a height $H_{ridge}$ of the projected ridge 122 that increases from zero at a first base end 130 at a base of the projected ridge 122, to at least one maximum peak along the cross-sectional profile, then back to zero at a second base end 132 at the base of the projected ridge 122. It will be appreciated that the base of the projected ridge 122 may be interpreted as the side 120 of the door frame 102, as described herein, in certain embodiments.

Figure 12A:
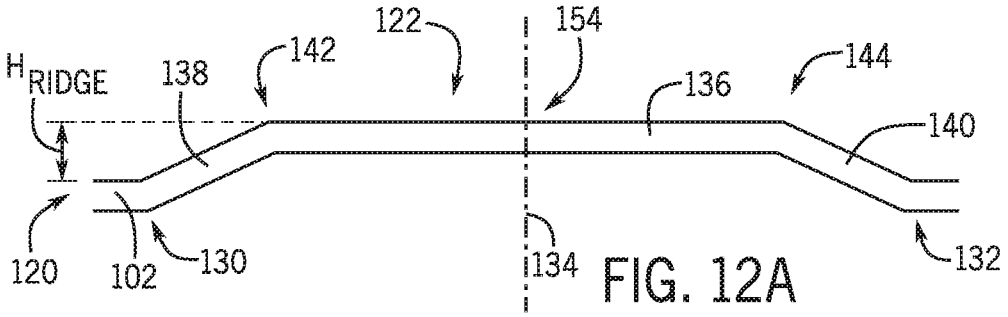
FIGS. 12A through 12I are cross-sectional views of profiles of a projected ridge, in accordance with the present techniques.
Figure 12B:
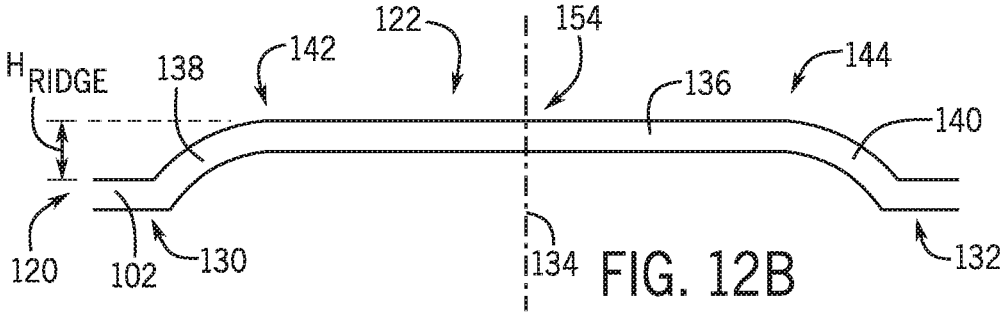
Figure 12C:
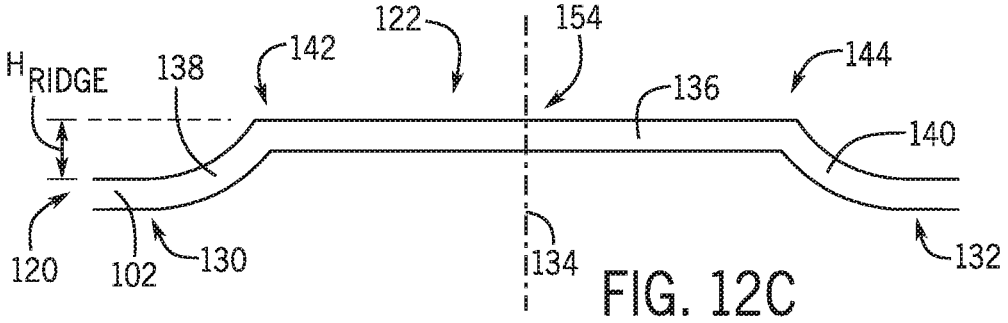

As but a few non-limiting examples, each of the embodiments illustrated in FIGS. 12A through 12F includes a cross-sectional profile where a height $H_{ridge}$ of the projected ridge 122 increases from zero at the first base end 130 at the base of the projected ridge 122, to a maximum height $H_{ridge}$ at a centerline 134 of the cross-sectional profile, then back to zero at the second base end 132 at the base of the projected ridge 122. For example, in the embodiment illustrated in FIG. 12A, the cross-sectional profile of the projected ridge 122 includes a substantially flat peak section 136 having sloping side sections 138, 140 that extend substantially linearly from boundaries 142, 144 of the substantially flat peak section 136 to the base of the projected ridge 122. However, in other embodiments similar to the embodiment illustrated in FIG. 12A, the sloping side sections 138, 140 may not be substantially linear, but may rather be arcuate or otherwise curvilinear, for example, not having a constant radius. For example, the sloping side sections 138, 140 may be convex curvilinear or concave curvilinear, as illustrated in FIGS. 12B and 12C, respectively. It will be appreciated that, in certain embodiments, the sloping side sections 138, 140 may include any combination of linear, arcuate, or curvilinear sloping side sections 138, 140.

Figure 12D:
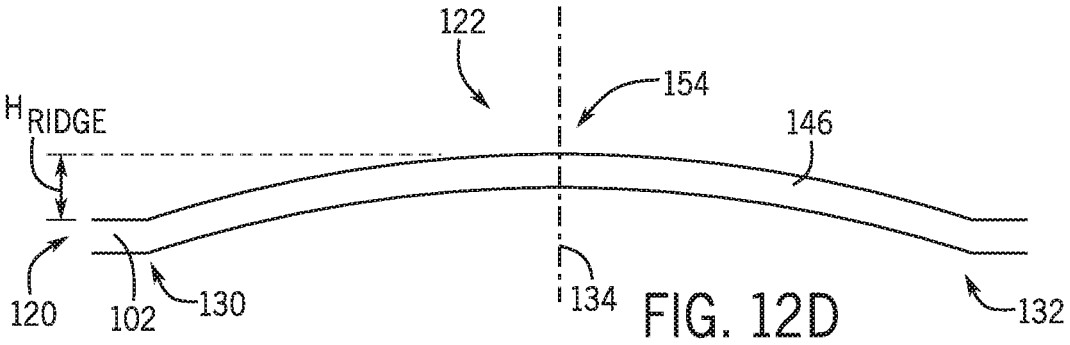
Figure 12E:
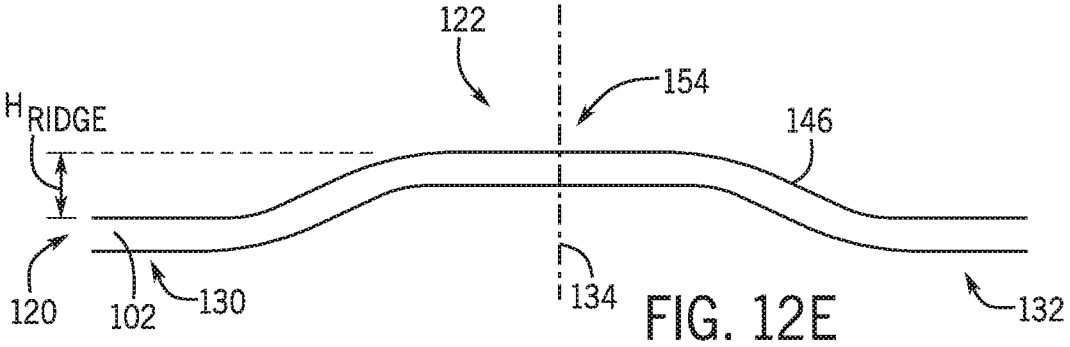

In the embodiment illustrated in FIG. 12D, the cross-sectional profile of the projected ridge 122 includes a single convex arcuate ridge section 146 that extends from the first base end 130 at the base of the projected ridge 122 to the second base end 132 at the base of the projected ridge 122. In the embodiment illustrated in FIG. 12E, the cross-sectional profile of the projected ridge 122 includes a single curvilinear ridge section 148 that extends from the first base end 130 at the base of the projected ridge 122 to the second base end 132 at the base of the projected ridge 122. It is noted that the embodiment illustrated in FIG. 12E is substantially similar to the embodiments illustrated in FIGS. 12A through 12C, however, the transitions from the base ends 130, 132 toward the maximum height $H_{ridge}$ at the centerline 134 of the cross-sectional profile are relatively smoother. In contrast, in the embodiment illustrated in FIG. 12F, the cross-sectional profile of the projected ridge 122 includes two ridge sections 150, 152 that extend substantially linearly from the respective base ends 130, 132 to the maximum height $H_{ridge}$ at the centerline 134 of the cross-sectional profile, thereby forming a single triangular projected ridge 122.

Although FIGS. 12A through 12F illustrate embodiments where the maximum height $H_{ridge}$ of the projected ridge 122 occurs at its centerline 134, in other embodiments, the maximum height $H_{ridge}$ of the projected ridge 122 may occur closer to one of the base ends 130, 132 of the projected ridge 122, thereby forming a projected ridge 122 having an asymmetrical cross-sectional profile. Specifically, it will be appreciated that a peak point (or points) 154 along the cross-sectional profiles for each of the embodiments illustrated in FIGS. 12A through 12F may be moved closer to one of the base ends 130, 132 of the projected ridge 122 in certain embodiments.

Also, although FIGS. 12A through 12F illustrate embodiments having a cross-sectional profile where the height $H_{ridge}$ of the projected ridge 122 increases from zero at the first base end 130 at the base of the projected ridge 122, to a maximum height $H_{ridge}$ along the cross-sectional profile, then back to zero at the second base end 132 at the base of the projected ridge 122, other embodiments of the projected ridge 122 may be used. For example, in the embodiment illustrated in FIG. 12G, the cross-sectional profile of the projected ridge 122 includes a base projection 156 that projects outwardly from the base of the projected ridge 122, and a peak projection 158 that projects further outwardly from the base projection 156. In the embodiment illustrated in FIG. 12H, the cross-sectional profile of the projected ridge 122 includes the base projection 156 that projects outwardly from the base of the projected ridge 122, and two peak projections 158 that each project further outwardly from the base projection 156. In the embodiment illustrated in FIG. 12I, the cross-sectional profile of the projected ridge 122 includes two peak projections 158 that each project outwardly directly from the base of the projected ridge 122, instead of projecting outwardly from the base projection 156.

Figure 12F:
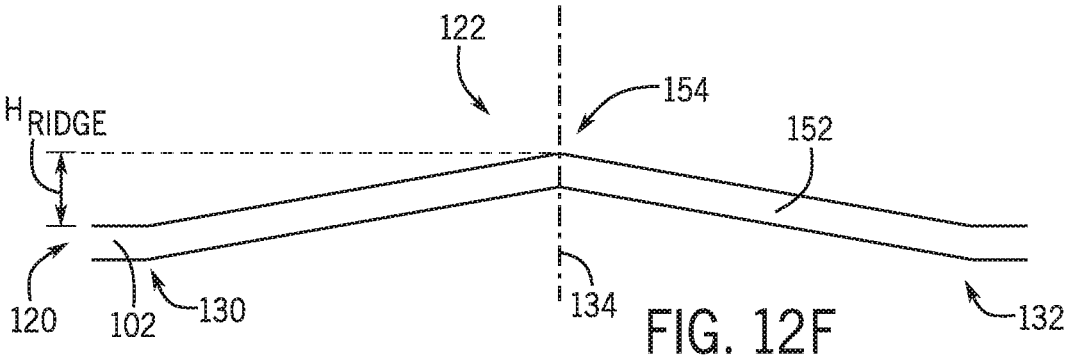
Figure 12G:
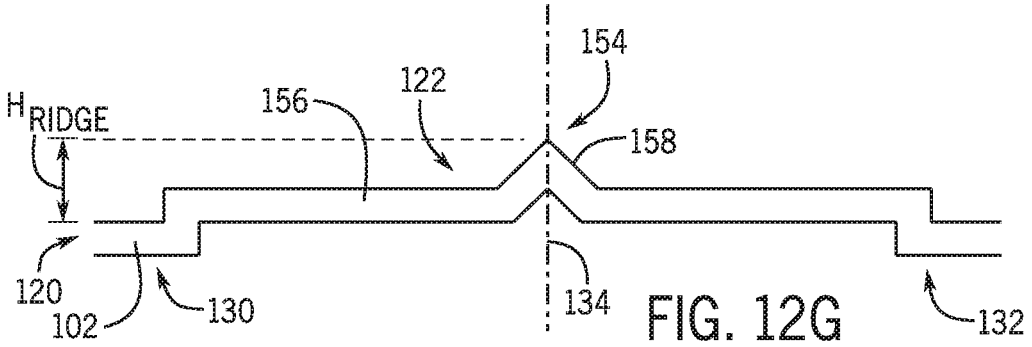
Figure 12H:
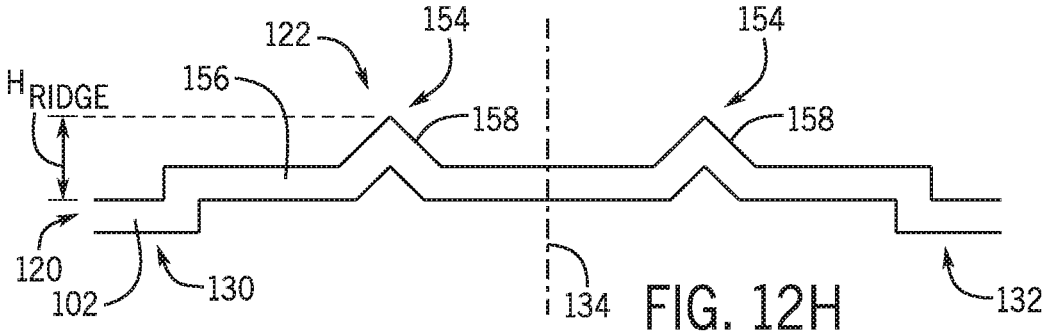
Figure 12I:
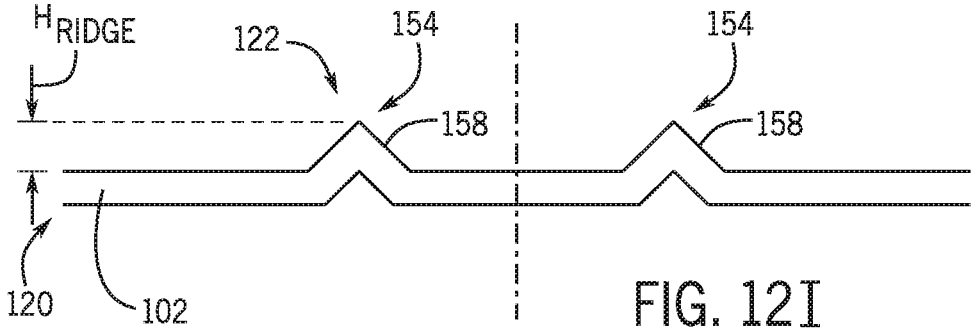

Although illustrated in FIGS. 12H and 12I as having a substantially similar peak height $H_{ridge}$, in other embodiments, the two peak projections 158 may instead have different peak heights $H_{ridge}$. In addition, although illustrated in FIGS. 12H and 12I as including two peak projections 158, in other embodiments, the projected ridge 122 may instead include three, four, five, six, seven, eight, or even more, peak projections 158. In addition, although primarily illustrated in FIGS. 12G through 12I as including triangular projections, such as illustrated in FIG. 12F, the peak projections 158 described herein may take the form of any of the embodiments of the projected ridge 122 illustrated in FIGS. 12A through 12F, in certain embodiments.

One or more of the disclosed embodiments, alone or in combination, may provide one or more technical effects useful in improving the design of HVAC access doors. For example, in general, embodiments of the present disclosure include relatively simple manufacturing designs that provide improved load distribution and deeper penetration between sealing components of an access door and its associated door frame to provide improved sealing along the perimeter of the access door with no additional latches for sealing, support structures for providing rigidity, and so forth.

While only certain features and embodiments of the present disclosure have been illustrated and described, many modifications and changes may occur to those skilled in the art, such as variations in sizes, dimensions, structures, shapes and proportions of the various elements, values of parameters, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and air conditioning (HVAC) system door assembly comprising:

a door comprising a panel having a first side and a second side opposite the first side, and a first seal circuit, wherein the first seal circuit affixed to the first side;

a door frame comprising a second seal circuit; and a ridge projecting from the second seal circuit and configured to align with and engage a gasket of the first seal circuit when the door is in a closed position with respect to the door frame, wherein the ridge comprises a cross-sectional profile having a flattened peak section with sloping side sections that extend from boundaries of the flattened peak section to a base of the ridge, and wherein the flattened peak section and the sloping side sections engage with the gasket when the door is in the closed position.

2. The HVAC system door assembly of claim 1, wherein the gasket comprises a flexible material.

3. The HVAC system door assembly of claim 1, wherein at least one of the sloping side sections of the cross-sectional profile is substantially linear.

4. The HVAC system door assembly of claim 1, wherein at least one of the sloping side sections of the cross-sectional profile is curvilinear.

5. The HVAC system door assembly of claim 1, wherein the cross-sectional profile comprises an arcuate portion.

6. The HVAC system door assembly of claim 1, wherein the flattened peak section is configured to deform the gasket of the first seal circuit.

7. The HVAC system door assembly of claim 1, wherein the second seal circuit is integral with the door frame.

8. The HVAC system door assembly of claim 1, comprising one or more latches configured to hold the door in the closed position with respect to the door frame, wherein the one or more latches comprise an accessible actuation mechanism disposed on the second side of the panel.

9. A heating, ventilation, and air conditioning (HVAC) unit comprising:

an enclosure comprising a plurality of walls; and a door assembly disposed in one of the plurality of walls, the door assembly comprising:

a door comprising a gasket affixed to a face of the door, wherein the gasket forms a first seal circuit; and a door frame comprising a ridge that projects from a side of the door frame, wherein the ridge forms a second seal circuit, the ridge is positioned on the side of the door frame such that the ridge and the gasket are configured to align and engage when the door is in a closed position with respect to the door frame, the ridge comprising a cross-sectional profile having a flattened peak section with sloping side sections that extend from boundaries of the flattened peak section to the side of the door frame, and wherein the flattened peak section and the sloping side sections engage with the gasket when the door is in the closed position.

10. The HVAC unit of claim 9, wherein at least one of the sloping side sections of the cross-sectional profile is substantially linear.

11. The HVAC unit of claim 9, wherein at least one of the sloping side sections of the cross-sectional profile is curvilinear.

12. The HVAC unit of claim 9, wherein the cross-sectional profile comprises an arcuate portion.

13. The HVAC unit of claim 9, wherein the ridge comprises a rigid material and the gasket comprises a flexible material such that the ridge is configured to deform the gasket when the door is in the closed position.

14. The HVAC unit of claim 9, wherein the one of the plurality of walls comprises a roof of the HVAC unit.

15. A heating, ventilation, and air conditioning (HVAC) unit comprising:

an enclosure comprising a plurality of walls; and a door assembly disposed in one of the plurality of walls, the door assembly comprising:

a door frame;

a door hingedly coupled to the door frame;

a gasket affixed to a face of the door and forming a first seal circuit;

and a ridge projecting from a side of the door frame and forming a second seal circuit, wherein the ridge comprises a cross-sectional profile having a flattened peak section with sloping side sections that extend from boundaries of the flattened peak section to the side of the door frame, and wherein the flattened peak section and the sloping side sections engage with the gasket when the door is in the closed position.

16. The HVAC unit of claim 15, wherein at least one of the sloping side sections of the cross-sectional profile is substantially linear.

17. The HVAC unit of claim 15, wherein at least one of the sloping side sections of the cross-sectional profile is curvilinear.

18. The HVAC unit of claim 15, wherein the cross-sectional profile comprises an arcuate portion.

19. The HVAC unit of claim 15, wherein the ridge comprises a rigid material and the gasket comprises a flexible material such that the ridge is configured to deform the gasket when the door is in a closed position.

20. The HVAC unit of claim 15, wherein the one of the plurality of walls comprises a roof of the HVAC unit.

* * * * *